US008212734B1

(12) United States Patent
Matyas et al.

(10) Patent No.: US 8,212,734 B1
(45) Date of Patent: Jul. 3, 2012

(54) HYBRID REFLECTOR WITH RADIATING SUBREFLECTOR

(75) Inventors: Gerard J. Matyas, Bala Cynwyd, PA (US); Wilhelmus H. Theunissen, Bensalem, PA (US); Michael Cuchanski, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 615 days.

(21) Appl. No.: 12/252,230

(22) Filed: Oct. 15, 2008

Related U.S. Application Data

(60) Provisional application No. 60/988,369, filed on Nov. 15, 2007.

(51) Int. Cl.
*H01Q 13/00* (2006.01)

(52) U.S. Cl. ..... 343/781 P

(58) Field of Classification Search ..... 343/781, 343/753, 755, 792, 840, 700 MS, 786, 78
See application file for complete search history.

(56) References Cited

U.S. PATENT DOCUMENTS

| | | | | |
|---|---|---|---|---|
| 4,342,035 | A * | 7/1982 | Anderson et al. | 343/792.5 |
| 5,373,302 | A * | 12/1994 | Wu | 343/781 P |
| 5,619,216 | A * | 4/1997 | Park | 343/771 |
| 5,889,498 | A * | 3/1999 | Lange et al. | 343/840 |
| 7,187,328 | B2 * | 3/2007 | Tanaka et al. | 343/700 MS |
| 2007/0254587 | A1 * | 11/2007 | Schadler et al. | 455/13.3 |

* cited by examiner

*Primary Examiner* — Huedung Mancuso
(74) *Attorney, Agent, or Firm* — McDermott Will & Emery LLP

(57) ABSTRACT

An antenna system comprises a first reflector and a second reflector including one or more radiating elements disposed on a side of the second reflector facing the first reflector. The one or more radiating elements are configured to illuminate the first reflector. The antenna system further comprises a dual reflector feed configured to illuminate the second reflector. The antenna system may further include a beamforming network configured to feed the radiating elements, and to provide amplitude weighting and/or phase control to the antenna system.

20 Claims, 7 Drawing Sheets

Prior Art

HYBRID REFLECTOR WITH RADIATING SUBREFLECTOR

CROSS-REFERENCE TO RELATED APPLICATION

The present application claims the benefit of priority under 35 U.S.C. §119 from U.S. Provisional Patent Application Ser. No. 60/988,369, entitled "HYBRID REFLECTOR WITH RADIATING SUBREFLECTOR," filed on Nov. 15, 2007, the disclosure of which is hereby incorporated by reference in its entirety for all purposes.

STATEMENT REGARDING FEDERALLY SPONSORED RESEARCH OR DEVELOPMENT

Not applicable.

FIELD OF THE INVENTION

The present invention generally relates to antenna systems and, in particular, relates to hybrid reflectors with radiating subreflectors.

BACKGROUND OF THE INVENTION

One approach to hybrid reflector antennas involves the use of a large secondary feed disposed in the path of the signal of the antenna system. One such reflector antenna is illustrated in FIG. 1. As can be seen with reference to this figure, dual-reflector feed 103 is configured to illuminate both reflector 102 and reflector 101 (i.e., reflector 102 directly, and reflector 101 by reflecting a signal off of reflector 102), and secondary feed 104, which may operate at a different frequency and/or polarization, is configured to illuminate reflector 101. The secondary reflector 102 is designed to be nearly transparent for the signal of the secondary feed 104. Because secondary feed 104 is disposed on an opposite side of reflector 102 from reflector 101, the signal with which secondary feed 104 illuminates reflector 101 is subject to some absorption by reflector 102. Secondary reflector 102 may also be fairly opaque at the frequency with which the antenna system operates, and may therefore absorb a significant amount of the signal, further contributing to system losses. This configuration is also less compact than may be desirable in many applications where size and mass are significant considerations, such as space-borne antenna systems or the like.

SUMMARY OF THE INVENTION

Various embodiments of the present invention solve the foregoing problems by providing a hybrid reflector system with a radiating subreflector. According to various aspects of the subject technology, the subreflector may have embedded thereupon one or more radiating elements facing the primary reflector. Such a design provides a more compact antenna geometry, while providing an increased number of design options, enabling, for example, multi-beam operations, dual-polarization operations, beam scanning operations, and the like.

According to one embodiment of the present invention, an antenna system comprises a first reflector and a second reflector including one or more radiating elements disposed on a side of the second reflector facing the first reflector. The one or more radiating elements are configured to illuminate the first reflector. The antenna system further comprises a dual reflector feed configured to illuminate the second reflector.

According to another embodiment of the present invention, an antenna system comprises a first reflector and a second reflector including a plurality of radiating elements disposed on a side of the second reflector facing the first reflector. The plurality of radiating elements are configured to illuminate the first reflector. The antenna system further comprises a dual reflector feed configured to illuminate the first and second reflector, and a beamforming network configured to feed the plurality of radiating elements.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

Figure 1:
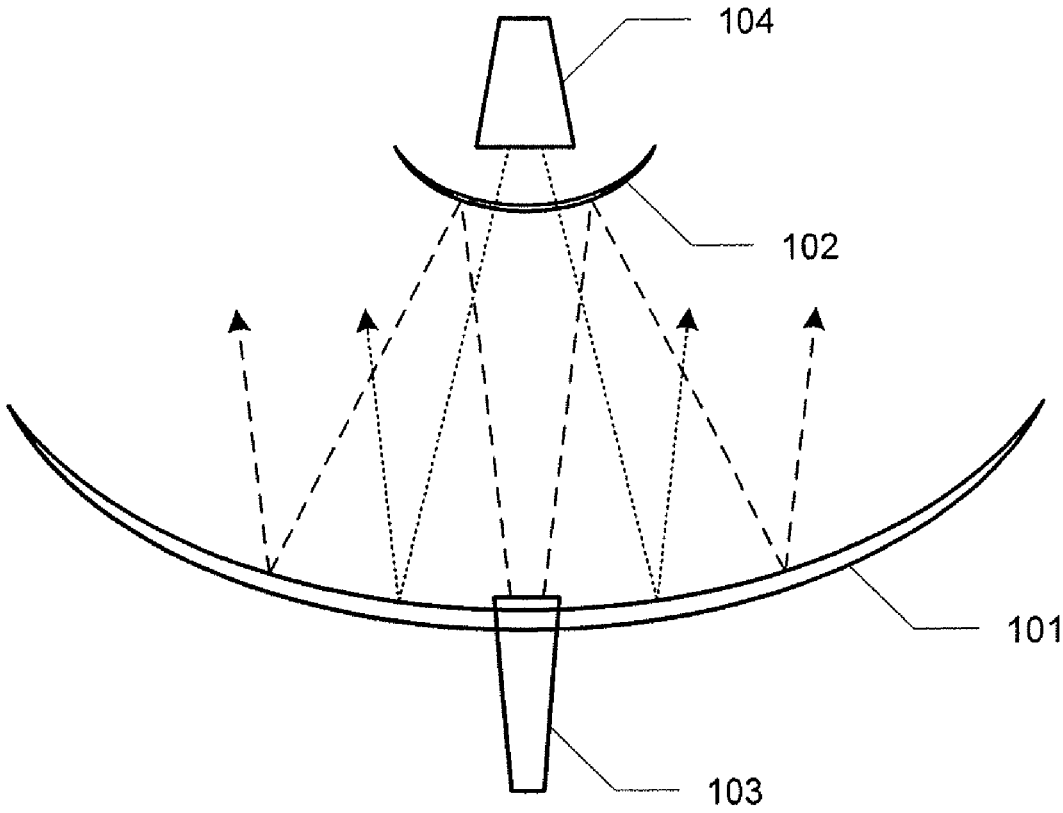
FIG. 1 illustrates a dual-reflector dual-feed antenna system.
Figure 2:
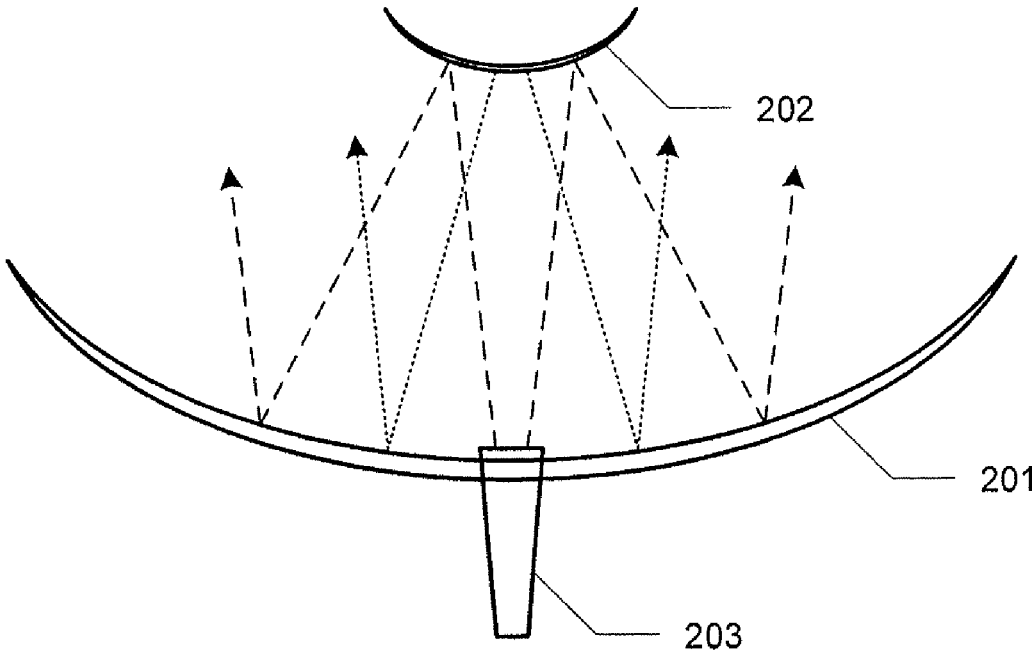
FIG. 2 illustrates an antenna system in accordance with one embodiment of the present invention.

FIG. 2 illustrates an antenna system in accordance with one embodiment of the present invention, in which a radiating subreflector is provided. The system includes a primary reflector 201, the radiating subreflector 202, and a dual-reflector feed 203. Radiating subreflector 202 includes one or more radiating elements disposed on the side of subreflector 202 which faces primary reflector 201. The one or more radiating elements are configured to illuminate primary reflector 201. By placing the radiating elements on the side of subreflector 202 which faces primary reflector 201, there is no material to absorb some of the signal of the radiating elements, as is the case with subreflector 102 and secondary feed 104. Moreover, the overall antenna geometry is more compact, and the signal from reflector 201 is subject to less absorption loss, as there is no large secondary feed in the signal path. According to another aspect of the present invention, the radiating elements disposed on subreflector 202 may be transparent at the frequency at which dual-reflector feed 203 operates, further contributing to improved system performance.

While the antenna system of FIG. 2 has been illustrated with the primary and secondary reflectors coaxial with the dual-reflector feed in a center-fed symmetric design, the scope of the present invention is not limited to such an arrangement. Rather, as will be readily understood by one of skill in the art, the present invention has application to antenna systems with off-set reflector geometry (e.g., in which the subreflector is offset from the center of the primary reflector) as well.

Figure 3:
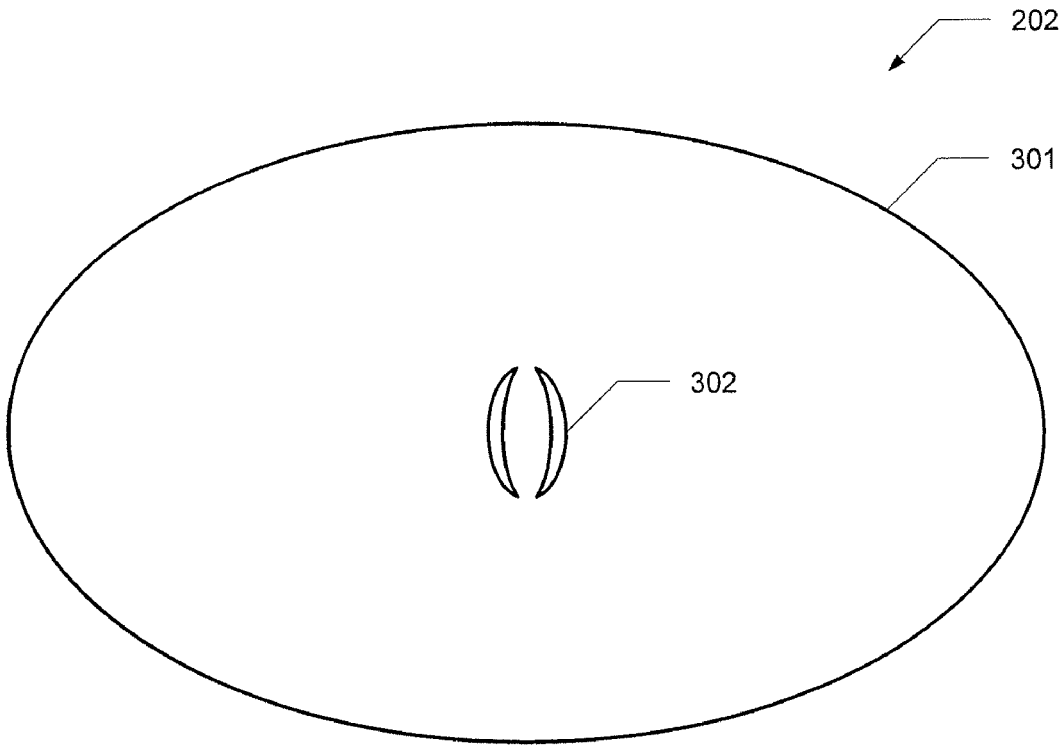
FIG. 3 illustrates a radiating subreflector in accordance with one aspect of the present invention.

FIG. 3 illustrates radiating subreflector 202 in greater detail, in accordance with one embodiment of the present invention. Subreflector 202 includes a reflector dish 301, and a radiating element 302 disposed in the center thereof. Radiating element 302 may be any one of a number of different radiating elements, either passive or active, including, for example, slot elements, dipole elements, patch elements (e.g., stripline and microstrip elements) and the like. According to another aspect of the present invention, radiating element 302 may be a multiband radiating element, for providing greater frequency capabilities to the antenna system.

In the exemplary embodiment illustrated in FIG. 3, radiating element 302 is disposed in a center of subreflector 202, co-axial with the center of primary reflector 201 in a fixed collinear beam design. The scope of the present invention is not, however, limited to such an arrangement. Rather, as will be readily apparent to one of skill in the art, radiating elements may be disposed off-center in a radiating subreflector to provide beam scanning capabilities, as illustrated in greater detail below with respect to FIG. 5.

Figure 4:
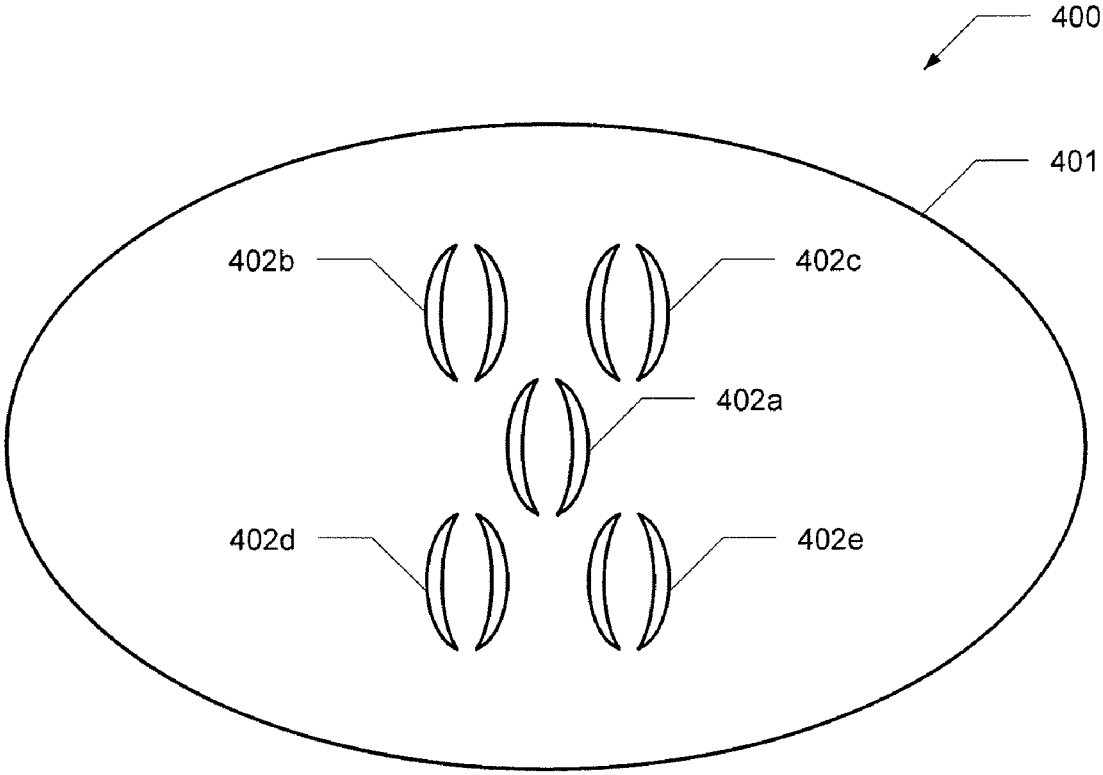
FIG. 4 illustrates a radiating subreflector in accordance with one aspect of the present invention.

Similarly, while FIG. 3 illustrates a radiating subreflector on which only one radiating element is disposed, the scope of the present invention is not limited to such an arrangement. Rather, as will be readily apparent to one of skill in the art, the present invention has application to radiating subreflectors on which is disposed more than one radiating element. For example, FIG. 4 illustrates another subreflector 400 in accordance with another exemplary aspect of the present invention. Subreflector 400 includes a reflector dish 401, on the surface of which five radiating elements 402*a*-402*e* are disposed. By providing four additional radiating elements (in comparison to subreflector 202), a hybrid antenna system employing radiating subreflector 400 may enjoy monopulse tracking capabilities, with which the range, bearing and elevation angle of a target can be obtained from a single pulse.

Figure 5:
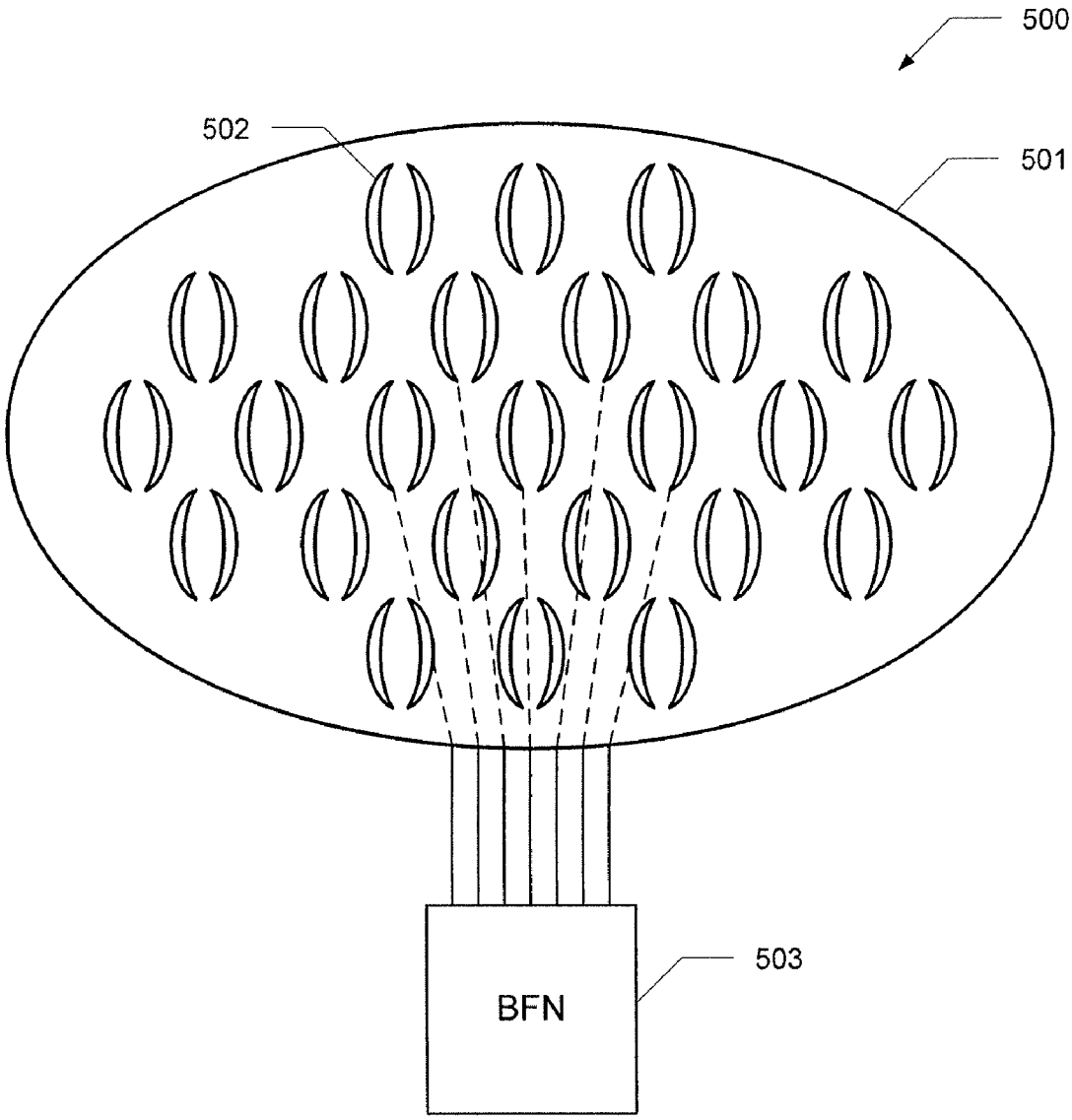
FIG. 5 illustrates a radiating subreflector in accordance with one aspect of the present invention.

Turning to FIG. 5, a radiating subreflector 500 is illustrated on which a large array of radiating elements 502 is disposed. Radiating elements 502 are fed from a beamforming network such as BFN 503, which may be mounted behind (i.e., on the opposite side than the primary reflector) or integral with the subreflector dish 501. By configuring BFN 503 to provide amplitude weighting to the various radiating elements 502, beam scan and sidelobe level control may be achieved. Similarly, by configuring BFN 503 to provide phase control, beam shaping can be provided and radiation efficiency can be improved. Moreover, by feeding different radiating elements from independent ports of BFN 503, multi-beam capability can also be provided. According to various aspects of the present invention, the beamforming network may be either digital or analog, as determined by mission and/or design requirements.

According to one aspect of the subject technology, the subreflector surface on which the radiating elements are disposed may approximate the Petzval surface, which provides optimum placement for scanned feeds.

Figure 6:
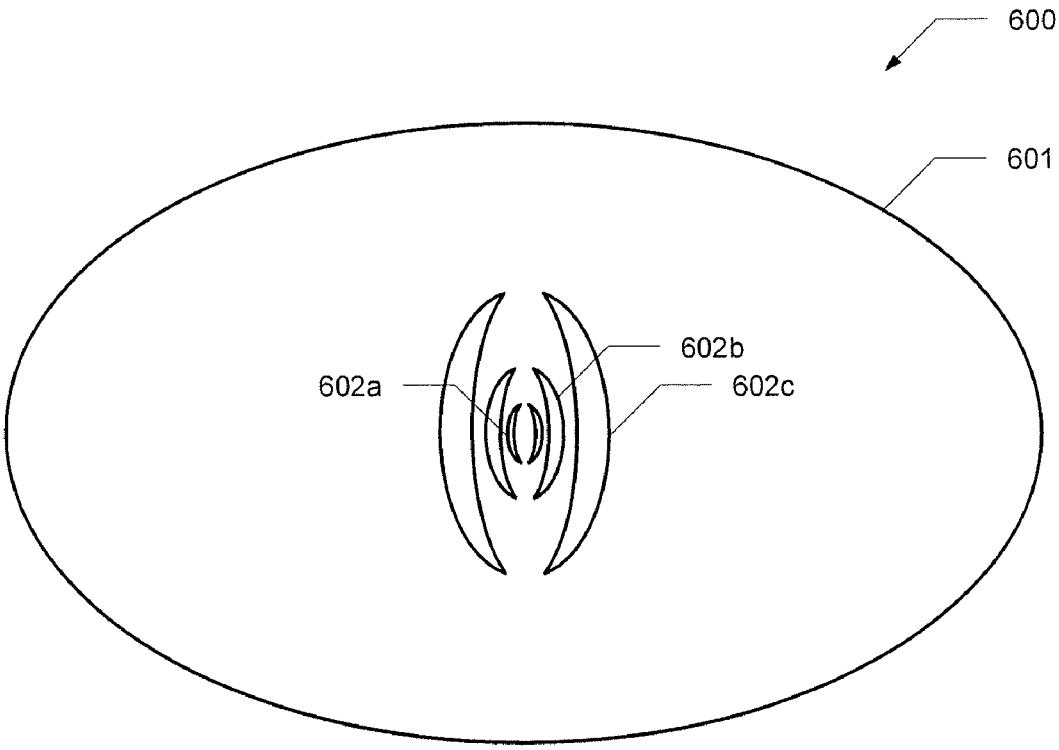
FIG. 6 illustrates a radiating subreflector in accordance with one aspect of the present invention.

Turning to FIG. 6, a radiating subreflector 600 is illustrated in accordance with yet another embodiment of the present invention. Subreflector 600 includes a reflector dish 601 in which are disposed a plurality of radiating elements 602*a*-602*c* with a co-located center. This arrangement provides additional frequency capability at multiple bands to the antenna system, as the radiating elements of different size can be configured to operate in different frequency bands. For example, in the present exemplary embodiment, radiating element 602*a* may be a higher-frequency element than co-located radiating element 602*b*, which is in turn a higher-frequency element than co-located radiating element 602*c*.

According to another aspect of the present invention, orthogonally oriented elements may be provided to enable dual polarization operation and frequency reuse. Such orthogonally oriented elements may optionally be provided by co-locating elements with different polarization in a fashion similar to the co-location of elements in FIG. 6. Alternatively, an array of radiating elements such as that illustrated in FIG. 5 may include some radiating elements of a first polarization, and other radiating elements of a second polarization orthogonal to the first.

Figure 7:
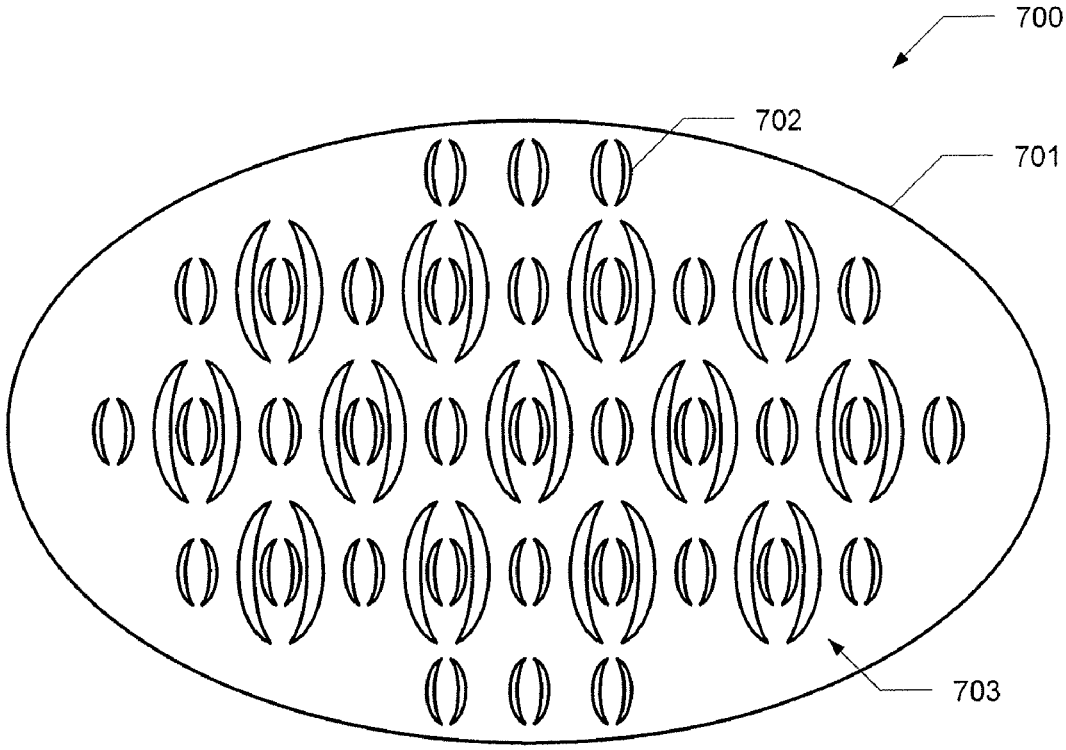
FIG. 7 illustrates a radiating subreflector in accordance with one aspect of the present invention.

Turning to FIG. 7, yet another exemplary radiating subreflector is illustrated in accordance with another exemplary aspect of the present invention. Subreflector 700 includes a reflector dish 701 and two interleaved arrays of radiating elements 702 and 703. Radiating elements 703 may be configured to provide a low-frequency array, while radiating elements 702 may be configured to provide a high-frequency array. By providing a beamforming network, such as BFN 503 of FIG. 5, a hybrid antenna system employing subreflector 700 may enjoy multibeam, multiport operation over a wide range of frequencies. According to another exemplary aspect of the present invention, interleaved arrays of radiating elements with orthogonal polarizations may be provided on a radiating subreflector, such as subreflector 700, to enable, together with an appropriate beamforming network, multibeam, multiport dual-polarization operation.

The description of the invention is provided to enable any person skilled in the art to practice the various embodiments described herein. While the present invention has been particularly described with reference to the various figures and embodiments, it should be understood that these are for illustration purposes only and should not be taken as limiting the scope of the invention.

There may be many other ways to implement the invention. Various functions and elements described herein may be partitioned differently from those shown without departing from the spirit and scope of the invention. Various modifications to these embodiments will be readily apparent to those skilled in the art, and generic principles defined herein may be applied to other embodiments. Thus, many changes and modifications may be made to the invention, by one having ordinary skill in the art, without departing from the spirit and scope of the invention.

A reference to an element in the singular is not intended to mean "one and only one" unless specifically stated, but rather "one or more." The term "some" refers to one or more. Underlined and/or italicized headings and subheadings are used for convenience only, do not limit the invention, and are not referred to in connection with the interpretation of the description of the invention. All structural and functional equivalents to the elements of the various embodiments of the invention described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description.

What is claimed is:

1. An antenna system comprising:

a first reflector comprising a first surface and a second surface;

a second reflector comprising a first surface and a second surface, wherein the first surface of the second reflector faces the second surface of the first reflector, wherein the first surface of the second reflector comprises one or more radiating elements, wherein the one or more radiating elements are configured to illuminate the second surface of the first reflector; and a dual reflector feed structurally arranged to only face the first surface of the second reflector and configured to illuminate the first surface of the second reflector.

2. The antenna system of claim 1, wherein the one or more radiating elements comprise one or more slot antenna elements, patch antenna elements, or dipole antenna elements.

3. The antenna system of claim 1, wherein the one or more radiating elements comprise one or more passive elements.

4. The antenna system of claim 1, wherein the one or more radiating elements comprise one or more active elements.

5. The antenna system of claim 1, wherein the one or more radiating elements include a plurality of radiating elements with a co-located center.

6. The antenna system of claim 5, wherein the plurality of radiating elements with the co-located center includes radiating elements with different operating frequencies.

7. The antenna system of claim 1, wherein the second reflector is disposed co-axially with the first reflector in a center-feed arrangement.

8. The antenna system of claim 1, wherein the second reflector is disposed off-center from the first reflector in an offset-feed arrangement.

9. The antenna system of claim 1, wherein the one or more radiating elements include orthogonally oriented radiating elements configured to provide dual polarization operation of the antenna system.

10. The antenna system of claim 1, wherein at least one of the one or more radiating elements are located off-center from the first reflector to provide beam scanning capability to the antenna system.

11. The antenna system of claim 1, wherein the dual reflector feed is further configured to illuminate the first reflector by reflecting a signal off of the second reflector.

12. An antenna system comprising:

a first reflector comprising a first surface and a second surface;

a second reflector comprising a first surface and a second surface, wherein the first surface of the second reflector faces the second surface of the first reflector, wherein the first surface of the second reflector comprises including a plurality of radiating elements, wherein the plurality of radiating elements are configured to illuminate the second surface of the first reflector;

a dual reflector feed structurally arranged to only face the first surface of the second reflector and configured to illuminate the second surface of the first reflector and the first surface of the second reflector; and a beamforming network configured to feed the plurality of radiating elements.

13. The antenna system of claim 12, wherein the plurality of radiating elements comprises one or more slot antenna elements, patch antenna elements, or dipole antenna elements.

14. The antenna system of claim 12, wherein the plurality of radiating elements includes at least one plurality of radiating elements with a co-located center.

15. The antenna system of claim 14, wherein the plurality of radiating elements with the co-located center includes radiating elements with different operating frequencies.

16. The antenna system of claim 12, wherein the second reflector is disposed co-axially with the first reflector in a center-feed arrangement.

17. The antenna system of claim 12, wherein the second reflector is disposed off-center from the first reflector in an offset-feed arrangement.

18. The antenna system of claim 12, wherein the plurality of radiating elements includes orthogonally oriented radiating elements configured to provide dual polarization operation of the antenna system.

19. The antenna system of claim 12, wherein the beamforming network is configured to provide amplitude weighting to the plurality of radiating elements to provide beam scan and/or sidelobe level control to the antenna system.

20. The antenna system of claim 12, wherein the beamforming network is configured to provide phase control to the plurality of radiating elements to provide beam shaping control to the antenna system.

* * * * *